US006202763B1

(12) United States Patent
Gude et al.

(10) Patent No.: US 6,202,763 B1
(45) Date of Patent: Mar. 20, 2001

(54) "TWIN-IMPACT" DOUBLE-BLOW DRILLING APPARATUS

(75) Inventors: Dieter Gude, Essen; Josef Maus, Velen, both of (DE)

(73) Assignee: Deilmann-Haniel Maschinin-und Stahlbau, Dortmund (DE)

( * ) Notice: Subject to any disclaimer, the term of this patent is extended or adjusted under 35 U.S.C. 154(b) by 0 days.

(21) Appl. No.: 09/296,171

(22) Filed: Apr. 22, 1999

(30) Foreign Application Priority Data

Aug. 12, 1998 (DE) ..... 198 36 389

(51) Int. Cl.[7] ..... B25D 9/22
(52) U.S. Cl. ..... 175/135; 173/105
(58) Field of Search ..... 173/13, 14, 15, 173/16, 17, 116, 125, 138, 139, 135, 105, 162.1, 208; 175/135, 113, 114

(56) References Cited

U.S. PATENT DOCUMENTS 3,629,927 * 12/1971 Palmer et al. ..... 29/240
4,460,051 7/1984 Widmer .
5,010,963 4/1991 Neroznikov .
5,056,606 10/1991 Barthomeuf .
5,415,240 5/1995 Mundjar .
5,667,022 9/1997 Güde .

FOREIGN PATENT DOCUMENTS 2 206 014 8/1973 (DE) .

* cited by examiner

*Primary Examiner*—Robert E. Pezzuto
(74) *Attorney, Agent, or Firm*—James Creighton Wray; Meera P. Narasimhan

(57) ABSTRACT

A drilling apparatus 1 having a twin-impact system can work continuously with a shank end 5 is provided with a compensation ring 10 on the rotary impact side, which has a material with hardness that is lower than that of the material of the pipe and striker 8 and/or corresponding to the adjacent end portion 11 of the shank end 5 and has a shape and/or surfaces 21, 22 to compensate for the applied forces.

22 Claims, 1 Drawing Sheet

"TWIN-IMPACT" DOUBLE-BLOW DRILLING APPARATUS

BACKGROUND OF THE INVENTION

The invention relates to a drilling apparatus having spun-up outer pipes and spun-up inner pipes, which can be driven by a rotary drive and a rotary impact drive, the outer pipe being adapted for coupling at one of shank ends projecting on both sides of the rotary drive and being engageable with a striker that is mounted on the inner pipe for axial movement therewith.

Drilling apparatuses of this type are used in special underground construction, in mining and earth-moving operations and in the construction industry. They are used to form holes in rocks for insertion and fastening of anchors when various rocks are used as a foundation for construction. Such drilling apparatuses have an outer pipe string and an inner pipe string, each of the outer pipes and inner pipes having threads for making up the pipe strings. When flushing fluid is caused to pass through the interior of the inner pipes from the flushing head to the core drill bit, the flushing fluid filled with cuttings is removed to the ground surface through the space defined between the outer pipes and the inner pipes. Normally, the inner pipe is driven by a rotary impact drive, and the outer pipe is driven by a rotary drive only. This can be a problem, especially in dealing with hard rock. Accordingly, as described in DE-PS 35 03 893, the rotary impact drive for the inner string is also used to act upon the rear end of the outer string. For that purpose, the inner string has an annular shoulder for the impact engagement with the outer string. The impact mechanism can be pulled back axially with the ring shoulder, whereby the drilling apparatus can work with the outer pipes being driven for rotation only. To resolve this problem, the design according to DE-PS 35 03 893 involves gear teeth provided at the end face of the annular shoulder and at the end of the outer pipe to form a rotary coupling between the outer pipes and the inner pipes. This gearing causes another problem relating to strong wear of the annular shoulder and also of the end portions of the outer pipe, so such drilling apparatuses cannot be used for a long time. It should be also borne in mind that the annular shoulder that comes to engage the end portion of the outer pipe is also rotated together with the inner pipes. The two rotary systems are positively interconnected through the gearing.

The invention is based on the problem of providing a drilling apparatus having a design in which an outer pipe can have a rotary or a rotary percussion connected to, and driven by, the drilling apparatus.

SUMMARY OF THE INVENTION

This problem is resolved, according to the invention, by the fact that the shank end is provided with a compensation ring on the rotary impact side, which has the hardness that is lower than that of the material of the pipe and striker and/or corresponds to that of the end portion of the shank end and has a form and/or surfaces to compensate for the applied forces.

Using an annular shoulder for the striker to engage the end portion of the shank end is known from DE-PS 35 03 893. In this particular case, a compensation ring is provided between two engageable parts, namely the end portion of the shank end and the striker, and is used for compensation between the rotating impact part and the striking impact part to avoid premature overloading of, or damage to, both the striker and the end portion. With the proper construction and material for the compensation ring, even when the compensation ring is worn, the compensation ring is still capable of transmitting the applied forces and blows. This is ensured by a particular configuration and surface, as well as the general form of the compensation ring, that does not generally require any special material of treatment regardless of whether the drilling apparatus is used for a rotary or rotary impact drive of the outer pipe. Only when, for any reason, extreme stresses occur under an overload, is it required that the compensation ring be replaced when it shows signs of damage.

In a preferred embodiment of the invention, the compensation ring has, on one side, a surface corresponding to the adjacent end portion of the shank end, which is three-dimensionally curved. This ensures the alignment of the compensation ring on the one side and the shank end on the other side without any need for exact guidance of both parts. At the same time, such a compensation ring and an appropriately designed shank end ensure the central application of forces to the outer pipe in the case of the offset application of forces. This ensures reliable compensation by means of the compensation ring.

It is especially preferred, according to the invention, that the compensation ring have surfaces on both sides surface corresponding to the adjacent end portions of the shank ends, which are three-dimensionally curved, and it is understood that the shank end on the one side and the striker on the other side have surfaces that are respectively curved. The compensation ring has its curved surface or surfaces on the respectively curved shank end at the respectively curved striker. As will become clear from the description, in this manner the compensation ring will always remain in an optimum position without any additional adjustment or control devices being required.

The compensation ring should be preferably installed at the shank end in such a manner that the compensation ring made as a loose part remains at the shank end when the impact drive with the striker is pulled back. In order to rule out slip, tilt, and the like, it is provided, according to the invention, that the shank end has a casing supported by the rotary drive motor encloses the compensation ring. It is preferred for the sake of simplicity to provide the casing with projections that are designed to fix the compensation ring, with the striker having a respectively smaller diameter to be received within the casing in such a manner as to be in contact with the respective surface of the compensation ring during the rotary percussion operation.

It should be also noted that with the rotary percussion mode for the outer pipe described herein, the inner pipe and the striker of the rotary impact drive rotate simultaneously, because the rotary impact drive is connected to the inner pipe or is made integrally therewith. To avoid damage to the smooth surfaces, which can be in contact with the drilling fluid, according to the invention, the casing has lubrication holes opposite to the curved surfaces of the compensation ring. Grease or the like can be put into these lubrication holes at regular intervals, e.g., before starting operation or on an as-needed basis so as to ensure lubrication of both surfaces of the compensation ring and the mating faces of the shank end and the striker.

To remove the grease moving under pressure on both sides sliding over each other and, more specifically, to facilitate insertion of the inner pipe through the compensation ring during assembly, it is preferred that the compensation ring have a central hole of a diameter that is larger than the diameter of the inner pipe. It is preferred that this central hole have a chamfer to reduce damage caused by blows of the striker in this area. It is also preferred that the striker also have the chamfered edge in this area, and the opposite side of the central hole may also have a chamfer.

To ensure guidance for the compensation ring in the casing on the one hand and to allow the compensation ring to reciprocate over the full range over the surfaces of the shank end and the striker, the outer edges of the compensation ring are rounded. In this manner, the compensation ring has rounded edges all around to ensure good support for the compensation ring between the faces of the shank end and the striker.

The striker is mainly a part of the inner pipe; it is appropriately driven by the rotary impact mechanism and can transmit the impact energy to the outer pipe string. To facilitate make-and-break operations and to optimize installation, according to the invention, the striker is made as a striker sleeve that is loosely connected to the shank end of the rotary impact drive. This shank end has appropriate threads for replacement of the attached striker sleeve when required, for ensuring its intimate contact with the rotary impact drive and with the rotary drive when the outer pipe is only rotated. Quick make-and-break operations are thus made possible, especially when it is required to replace the striker sleeve for a larger or smaller striker sleeve or when a simple replacement is needed.

The compensation ring is engageable with the striker sleeve to assure the optimum transfer of appropriate forces if, according to the invention, the compensation ring has the outside diameter that corresponds to, and is preferably larger than, that of a head of the striker sleeve and of the shank end. The greater diameter of the compensation ring is advantageous in the case where the compensation ring is fixed in bosses or lugs of the casing. Otherwise, the compensation ring has the same diameter.

The rotary drive and the rotary impact drive are axially movable together so as to move or drive the interconnected outer and inner pipes with their respective strings into the hole. To allow for independent operation, according to the invention, the striker sleeve is axially movable together with the rotary impact drive independently of the rotary drive of the outer pipe. The rotary impact drive is thus retracted from the striker sleeve in such a manner that it can be only driven to rotate so that the outer pipe will only rotate, and the inner pipe will be driven by the rotary impact drive to assure hole formation. As the outer pipe is to be driven only through a relatively limited thickness of the ground shell, the rotary drive is used for a soft rock, and the striker sleeve can be retracted from the compensation ring and from the shank end to facilitate movement of the pipe strings.

To avoid injuries to the drilling crew, the striker sleeve is dogboned and has a funnel-shaped protective cover that is fixed at the end opposite to the compensation ring and covers the casing in a spaced relation thereto in the area of the compensation ring. This protective cover is preferably made of a flexible material, e.g., of hard rubber or plastic. It covers the striker area, i.e., the area in which the striker sleeve engages the compensation ring. If the striker sleeve is to be retracted from the compensation ring, the protective cover is made "shorter" and is preferably attached to the inner pipe, or more exactly, to the striker sleeve in order to move together therewith. The striker sleeve is in contact with the compensation ring, thus engaging the outer string and the shank end, and the protective cover is sealed against a respective projection of the casing, so that mishandling by the drilling crew cannot and does not damage the apparatus. If required, e.g., for inspection of the striker sleeve, the protective cover, which is secured by means of a retainer ring to the dogboned striker sleeve, may be removed.

It can be also noted that both the shape and the material of the compensation ring are such that the ring can perform its compensating function. The material is chosen in such a manner that, on the one hand, it can reliably transmit the impact of the striker sleeve to the shank end and then to the outer pipe and, on the other hand, the same shank end is protected and is not damaged by the blows. Both the form and the material are also chosen in such a manner that the blows that are transmitted in an imperfect alignment do not inflict damage upon respective parts, and the rotating striker sleeve is as if being centered by means of the compensation ring. The compensation ring can shift aside or tilt even inside of the surfaces of the compensation ring, and the shank end and striker sleeve are appropriately shaped. Generally speaking, according to the invention, if the compensation ring has hardness, as well as heat conductivity and other properties chosen so as to differ from the material of the shank end and striker sleeve, and its toughness is preferably higher, the compensation ring can perform its function.

It is preferred that this material be bronze and more specifically, forged bronze. Forged bronze ensures optimum properties for the compensation ring. It can take up the forces between the striker sleeve and the shank end both in terms of the hardness and toughness without causing damage to these parts.

The invention is characterized by the fact that it provides a drilling apparatus that can be used for driving the outer pipe string in both the rotary and rotary percussive mode. The rotary drive is used for driving the inner pipe string or inner pipe in the known manner, with the outer pipe being simultaneously driven by impacts. Between individual parts, namely between the striker sleeve on the one side and the end face of the shank end coupled with the outer pipe, there is provided a compensation ring that is used for compensation in every aspect, which also allows the impacts transmitted from the rotary impact drive to be transferred to the outer pipe when required. The compensation ring is also used to protect against heat, as well as excessive energy at the shank ends, especially at the end of the striker sleeve. The positive centering and the reliable transmission of forces are assured owing to a specific configuration of the compensation ring. In general, a drilling apparatus is provided that has prolonged life and that can work continuously when used for drilling in very hard rocks, with the outer pipes being driven in the rotary percussive mode continuously for a long time.

Other features and advantages of the present invention will become apparent from the following detailed description of its embodiments in conjunction with the accompanying drawings, in which:

DETAILED DESCRIPTION

Figure 1:
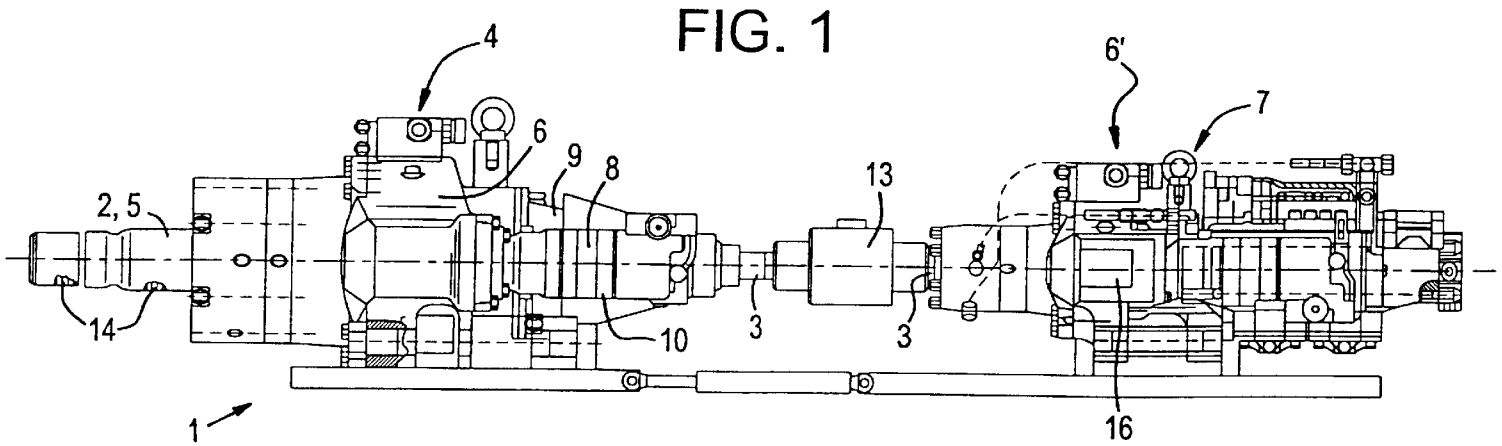
FIG. 1 is a general view of a drilling apparatus having a twin impact clutch, in front elevation view.

A drilling apparatus 1 for two pipe strings is shown in front elevation view in FIG. 1. An outer pipe is shown at 2, and an inner tube having a smaller diameter is shown at 3. While the outer pipe 2 is engaged for rotation with a rotary drive 4, which is not described in detail here, a rotary drive motor 6 is used for driving a rotary impact driven 7 with a striker device to drive the inner pipe 3 in the rotary percussive mode.

FIG. 1 shows a shank end 5 of the end of the outer pipe 2, having twin threads 14.

The rotary drive 4 and the rotary impact drive 7 are axially movable together on a slide, which is not referenced, so that the drilling pipe strings can be driven as a whole into the rock or into a building structure. The slide is divided into two parts. The parts are connected together by means of a hydraulic cylinder for retracting the rotary impact mechanism from the rotary drive.

The outer pipe 2 and the shank end 5 should be driven not only for rotation by the rotary drive 4, but also simultaneously in the rotary percussive mode, which is required, e.g., in the case where the twin pipe string is to be driven through rock such as stone. When the rock or stone hardness requires that a striker 8 be activated in order to drive the outer pipe 2 not only for rotation by the rotary drive 4, but also under the action of the striker 8 for percussive driving, the striker 8 is moved toward casing 9 by the hydraulic cylinder to a position in which it engages a compensation ring 10. In this case the inner pipe string, more specifically, the inner pipe 3 will transmit the impact energy to the outer pipe 2. This can be more clearly seen in FIG. 2.

Similarly to the rotary drive 4, the rotary impact drive 7 has a shank end 16 or a tail pipe that is in engagement with a rotary drive motor 6' and a hammer member that is not shown. A force is transmitted directly from the shank end 16 to the inner pipe 3. FIG. 1 also shows a flushing head 13 through which flushing fluid is supplied into an inner passage 20 of the inner pipe 3 and, more specifically, to the rotating inner pipe 3.

Figure 2:
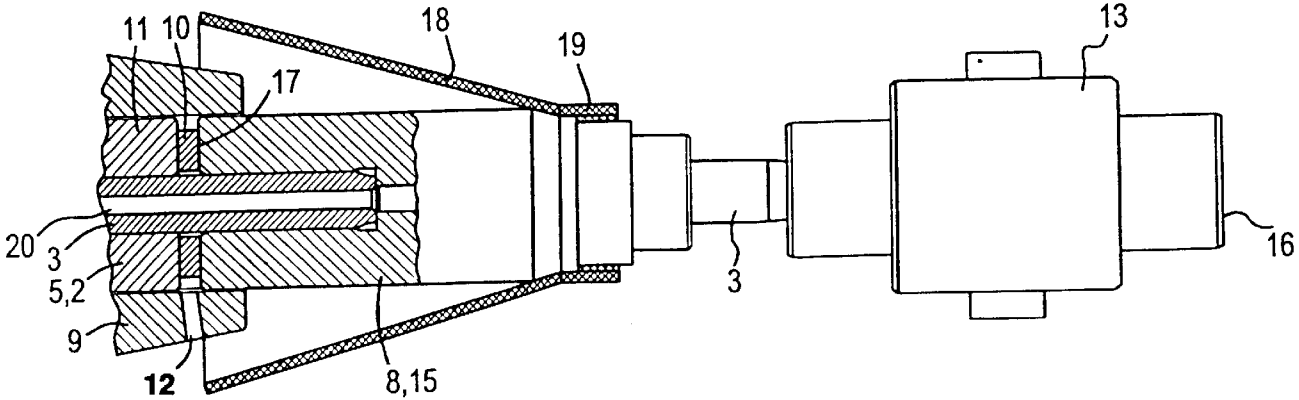
FIG. 2 is a sectional view taken in the area of a compensation ring.

FIG. 2 also shows the flushing head 13 that is mounted on the inner pipe 3, and the striker 3 that is made as a striker sleeve 15. The striker sleeve 15 acts through the compensation ring 10 upon the end portion 11 of the shank end 5 and, through it, upon the outer pipe 2. The inner pipe 3 is connected to the striker sleeve 15 by means of threads that are not shown here. A head 17 of the striker sleeve 15 directly engages the compensation ring 10, the rotary motion of the striker sleeve 15 is not restricted, and grease is pressed through lubrication holes 12 that are located in the area of the compensation ring 10.

The drawing also shows the inner passages 20 through which the flushing fluid is supplied toward a core drill bit that is not shown.

The head 17 of the striker sleeve 15 and the end portion of a casing 19 with the appropriately positioned compensation ring 10 are enclosed in, and protected by, a protective cover 18 that is attached to the end 19 of the striker sleeve 15, which is apart from the compensation ring 10, for reciprocation with the striker sleeve 15 and for covering the compensation ring during operation in the impact mode.

Figure 3:
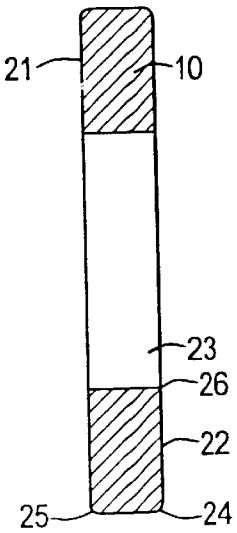
FIG. 3 is a sectional view of the compensation ring.

FIG. 3 shows a sectional view of the compensation ring 10, wherein surfaces 21 and 22 on both sides of the compensation ring 10 are shown as planar. Actually, as mentioned in the specification, these surfaces 21, 22 are three-dimensionally curved, among other things, to ensure self-alignment of the striker sleeve 15 in the percussive mode and to increase the surface area (contact area).

A central hole 23 is greater than the outside diameter of the inner pipe 3, which can be clearly seen in FIG. 2, to facilitate insertion of the inner pipe without the inner pipe affecting the compensation ring 10.

Outer edges 24, 25 are rounded as can be seen in FIG. 3, and inner edge 26 can also be rounded or chamfered.

The compensation ring 10 is made of the above-discussed tough material, and the surfaces 21, 2 should be sufficiently smooth to be able to eventually assure uniform movement of the rotating striker sleeve 15 even without a lubricant. It should be understood that the respective opposite surface of the striker sleeve 15 and the respective surface of the shank end 5 are also finished smoothly.

All the above-described features of the invention illustrated in the drawings can be used, according to the invention, singly or in combination.

What is claimed is:

1. A drilling apparatus comprising a spun-up outer pipe and a spun-up inner pipe, a rotary drive for driving the inner and the outer pipes, a rotary impact drive, shank ends on ends of the outer pipe engageable with the rotary drive and adapted for engaging a striker mounted on the inner pipe for axial movement together with the inner and the outer pipes, a compensation ring on the shank end on a same side as the rotary impact drive, the compensation ring having a hardness lower than a hardness of a material of the inner pipe, the outer pipe and the striker, and the compensation ring having a structure sufficient to compensate for applied forces.

2. The apparatus of claim 1, wherein the hardness of the compensation ring is lower than a hardness of an adjacent end portion of the shank end.

3. The apparatus of claim 2, wherein the compensation ring is shaped to form the structure sufficient to compensate for the applied forces.

4. The apparatus of claim 2, wherein the compensation ring has a formed surface sufficient to compensate for the applied forces.

5. The apparatus of claim 4, wherein the formed surface on the compensation ring is a three-dimensionally curved surface on one side corresponding to the adjacent end portion of the shank end.

6. The apparatus of claim 4, wherein the formed surface on the compensation ring is three-dimensionally curved surfaces on two sides corresponding to the adjacent end portion of the shank end.

7. The apparatus of claim 1, further comprising a casing of the rotary drive motor on the end portion for enclosing the compensation ring.

8. The apparatus of claim 7, further comprising lubrication holes on the casing and curved surfaces on the compensation ring, wherein the holes are opposite the curved surfaces.

9. The apparatus of claim 1, wherein the compensation ring has a central hole larger than a diameter of the inner pipe.

10. The apparatus of claim 1, wherein outer edges of the compensation ring are rounded.

11. The apparatus of claim 1, wherein the striker is a striker sleeve loosely connected to a shank end of the rotary impact drive.

12. The apparatus of claim 1, wherein an outer diameter of the compensation ring is complementary to a head of the striker sleeve and of the end shank.

13. The apparatus of claim 12, wherein the outer diameter is greater than the head and the end shank.

14. The apparatus of claim 1, wherein the striker sleeve is axially movable together with the rotary impact drive independently of the rotary drive of the outer pipe.

15. The apparatus of claim 1, wherein the striker sleeve has a dog-bone shape.

16. The apparatus of claim 15, further comprising a funnel-shaped protective cover attached to one end of the striker sleeve opposite the compensation ring.

17. The apparatus of claim 1, further comprising a casing of the rotary drive motor on the end portion for enclosing the compensation ring, and wherein the protective cover covers the casing in a spaced relation thereto proximal the compensation ring.

18. The apparatus of claim 11, wherein the compensation ring is of a material having properties different from properties of a material of the shank end and the striker sleeve.

19. The apparatus of claim 11, wherein the material of the compensation ring is tougher than the material of the shank end and the striker sleeve.

20. The apparatus of claim 11, wherein the properties include hardness, conductivity and wearability.

21. The apparatus of claim 1, wherein the compensation ring is of bronze material.

22. The apparatus of 11, wherein the material of the compensation ring is forged bronze.

* * * * *